US006145464A

United States Patent [19]

Machida

[11] Patent Number: 6,145,464

[45] Date of Patent: Nov. 14, 2000

[54] DANFORTH TYPE ANCHOR

[76] Inventor: Yukiharu Machida, 12-16, Futaba-cho, Kochi-shi, Kochi, 780-0815, Japan

[21] Appl. No.: 09/521,595

[22] Filed: Mar. 9, 2000

[30] Foreign Application Priority Data

Mar. 17, 1999 [JP] Japan ..... 11-072331

[51] Int. Cl.[7] ..... B63B 21/38

[52] U.S. Cl. ..... 114/304; 114/309

[58] Field of Search ..... 114/294, 301, 114/304, 309; D12/215

[56] References Cited

U.S. PATENT DOCUMENTS 3,101,694 8/1963 Wood, Jr. ..... 114/309
4,559,893 12/1985 Ogg ..... 114/304

FOREIGN PATENT DOCUMENTS 6-57794 8/1994 Japan .

*Primary Examiner*—Ed Swinehart
*Attorney, Agent, or Firm*—Frishauf, Holtz, Goodman, Langer & Chick, P.C.

[57] ABSTRACT

Provided is a Danforth type anchor by which anchor effect is obtained rapidly and reliably, and can be lifted up certainly. The anchor comprises a base unit; a pair of flat plate flukes projecting horizontally outward from the base unit; a shank joined at its base end portion to the base unit; and an orientation control rod provided in the base unit, the base unit including (A) flat plate-like support base plates each of which is formed of (i) a front portion extending at right angle to the reference plane in which the flukes extend and having upper and lower edges inclined outward toward the rear end thereof, and (ii) a rear end portion formed integrally with the front portion and having upper and lower edges inclined outward; and (B) a pair of secondary guide plates fixed to the inclined upper and lower edges of the rear end portions of the support base plates, the secondary guide plates having at their respective rear end sections bent rear end portions being bent to incline inward.

10 Claims, 4 Drawing Sheets

DANFORTH TYPE ANCHOR

BACKGROUND OF THE INVENTION

1. Field of the Invention

This invention relates to a Danforth type anchor, an anchor for ships.

2. Description of the Prior Art

Various types of anchors including Danforth type, navy type, mushroom type, holding type and stock type anchors are generally known as anchors for fixing a ship on the water, and a suitable anchor is selected and used in accordance with the particular conditions, such as the dimensions, kind and purpose of use of the ship concerned.

Among these anchors, especially, a Danforth type anchor can be handled simply and stored easily because of its small dimensions and has a low price, so that this anchor is suitable for a comparatively small-sized ship, such as a pleasure fishing vessel, a pleasure boat or the like.

FIG. 6 is a perspective view for describing a Danforth type anchor of the prior art. Referring to this drawing, a reference numeral 31 denotes a shank, 35 fluke, 40 a base unit, and 45 an orientation control rod.

The base unit 40 has a pair of support base plates 36, 36 extending longitudinally in vertical planes in parallel with each other, and is provided by welding with flat plate type flukes 35, 35 so that the flukes project horizontally from the outside of the support base plates 36, 36 and extend forward. Reference numerals 37, 37 denote a pair of secondary guide plates provided on the rear end portions of the support base plates 36, 36 by welding the guide plates to upper and lower edges of the rear end portions unitedly.

The orientation control rod 45 is fixed to the support base plates 36, 36 in a state that it is passed through, and projects horizontally to the outsides of both support base plates 36, 36 in the lateral direction, and extends beyond outer edges of the flukes 35, 35. The shank 31 is inserted at its base end portion in a clearance G between the pair of support base plates 36, 36, and connected to the orientation control rod 45 so that the shank can be turned in both upward and downward directions around the same rod 45 as a pivot. Accordingly, the shank 31 is supported so that it can be turned vertically in a vertical plane passing through the clearance G between the two flukes 35, 35. A reference numeral 32 denotes a shank ring.

The angular range of pivotal movement of the shank 31 is the range between limits at which the shank engages the front edges of the upper and lower secondary guide plates 37, 37, and, usually, the angular range corresponds to the sum of the first angular range between a plane of a reference direction coincident with the direction in which the flukes 35, 35 extend and a plane, for example, about 45° from the plane of the reference direction in the upward direction, and the second angular range between the plane of the reference direction and a plane about 45° from the reference direction in the downward direction, i.e. an angular range of about 90° in total centering around the plane of the reference direction. The shank 31 is unable to turn beyond this angular range.

The Danforth type anchor 30 of such a construction is used as shown in FIG. 7 by joining one end of a metal chain 33 to the shank ring 32 at a front end of the shank 31 thereof, while a mooring rope 34 extending from a ship is joined to the other end of the metal chain 33. Thus, when the Danforth type anchor with the metal chain 33 and mooring rope 34 joined thereto is cast from a ship into the water, the anchor submerges under water due to its our weight.

When the anchor reaches the bottom of the water, it is laid in a substantially horizontally extending state, in which the orientation control rod 45 extends horizontally and the support base plates 36 of the base unit 40 extend vertically, with either of the surfaces of the flukes 35 constituting an upper surface owing to the function of the orientation control rod 45. In a case where the anchor submerges under water with the flukes 35 extending vertically, one free end of the orientation control rod 45 reaches the bottom of the water first, so that the anchor turns down about this end of the orientation control rod 45 due to the orientation of the center of gravity of the whole anchor. As a result, the anchor on the bottom of the water always assumes an orientation with either one of the surfaces of the flukes 35 constitutes an upper surface due to the function of the secondary guide plates 37.

The operation of the Danforth type anchor is completely the same whether the either of the surfaces of flukes 35 constitutes the upper surface. The reason is that the Danforth type anchor has a laterally symmetric structure with respect to an axis along which the shank 31 extends, and a vertically symmetric structure with respect to a plane in which the flukes 35, 35 extend.

On the bottom of the water, the shank 31 lays extending along the water bottom surface S as shown in FIG. 7, owing to the weight of the metal chain 33 joined to the free end thereof. In this condition, the Danforth type anchor is pulled forward via the mooring rope 34 to move in an orientation in which the free end of the shank 31 is positioned in front, by moving the ship. At the same time, the anchor maintains its orientation in which the secondary guide plates 37 are positioned on the water bottom surface S, so that the sharp front end portions of the flukes 35, 35 are put in a sand-thrust state and further bit into the sand. As a result, the anchor itself is fixed to the bottom of the water, and enables the ship to be anchored.

At this time, the shank 31 is in the condition in which it has been turned by a certain angle from the reference direction.

In order to fix the Danforth type anchor reliably to the bottom of the water, the mooring rope 34 is usually set to have a length 3–5 times as long as the depth of the water. When the mooring rope 34 of such a length is put in a strained state while the ship is anchored, an angle made by the water bottom surface, which is parallel to the water surface, with the mooring rope 34 may become not larger than 20°. As a result, the angle made by the shank 31 with the water bottom surface also may become small. Therefore, for example, even when the ship is moved by the wind, etc. to cause the mooring rope 34 to be put in a strained state, the Danforth type anchor is not extracted out from the water bottom but the fixed condition thereof is kept.

In order to fix the Danforth type anchor stably when the waves are high or when the wind is strong, it is effective to use a mooring rope 34 of a still greater length, for example, a length not smaller than five times the depth of the water, and thereby making the angle made by the shank 31 with the water surface smaller.

However, when the Danforth type anchor is fixed to the water bottom by using such a longer mooring rope 34, the area within which the ship may be moved on the water surface enlarges. Therefore, the position of the ship is not stabilized, and the possibility that the ship deviates greatly from, for example, an intended fishing point becomes large.

Under the circumstances, it is demanded that a Danforth type anchor capable of being fixed to the water bottom reliably even when the waves are high and the wind is strong be developed.

SUMMARY OF THE INVENTION

The present invention has been made on the basis of such circumstances, and it is an object of the present invention to provide a Danforth type anchor capable of obtaining an anchoring effect reliably.

Another object of the present invention is to provide a Danforth type anchor having a capability of obtaining an anchoring effect rapidly.

A further object of the present invention is to provide a Danforth type anchor having a capability of varying the direction in which the shank extends, when a regular anchor lifting operation is impossible, so that the lifting of the anchor can be done certainly.

According to one aspect of the present invention, the Danforth type anchor comprises a base unit; a pair of flat plate flukes projecting horizontally outward from both sides of the base unit, extending forward to form sharp front ends, and being made integral with the base unit; a shank joined at its base end portion to the base unit so as to turn in a plane of pivotal movement which is at right angles to a reference plane in which the flukes extend, passing through the clearance between the flukes; and an orientation control rod provided in the base unit, projecting horizontally outward from both sides thereof, the base unit including (A) two parallel flat plate-like support base plates each of which is formed of (i) a front portion extending at right angle to the reference plane in which the flukes extend and having upper and lower edges inclined outward toward rear end thereof, and (ii) a rear end portion formed integrally with the front portion, having upper and lower edges inclined in a further outward directions than the extension lines of the upper and lower edges of the front portion; and (B) a pair of secondary guide plates fixed to the inclined upper and lower edges of the rear end portions of the support base plates and extending to project rearward outward from the rear ends of the support base plates.

In this structure, it is preferable in the support base plates that the angle of inclination of the upper and lower edges of the front portions thereof with respect to the reference plane be in the range of 5 to 12 degrees, and that the angle of inclination of the upper and lower edges of the rear end portions thereof with respect to the extension lines of the upper and lower edges of the front portions be in the range of 3 to 10 degrees.

According to a further aspect of the present invention, the Danforth type anchor comprises a base unit; a pair of flat plate flukes projecting horizontally outward from both sides of the base unit, extending forward to form sharp front ends, and being made integral with the base unit; a shank joined at its base end portion to the base unit so as to turn in a plane of pivotal movement which is at right angle to a reference plane in which the flukes extend, passing through the clearance between the flukes; and an orientation control rod provided in the base unit, projecting horizontally outward from both sides thereof, the base unit including (A) two parallel flat plate-like support base plates each of which is formed of (i) a front portion extending at right angle to the reference plane in which the flukes extend and having upper and lower edges inclined outward toward the rear end thereof, and (ii) a rear end portion formed integrally with the front portion and having upper and lower edges inclined outward; and (B) a pair of secondary guide plates fixed to the inclined upper and lower edges of the rear end portions of the support base plates and extending to project rearward outward from the rear ends of the support base plates, the secondary guide plates having at their respective rear end sections bent rear end portions being bent to incline inward.

In this structure, it is preferable that the angle of the bent rear end portions of the secondary guide plates with respect to the reference plane be in the range of 8–22 degrees. Each of the secondary guide plates has a longitudinally elongated rectangular shape, and it is preferable that a ratio of its longitudinal length to the lateral length be 1.2–2.0.

Each of the rear end portions of the support base plates preferably has upper and lower edges inclined in a further outward directions than the extension lines of the upper and lower edges of the front portion thereof.

In the above-described Danforth type anchor, the secondary guide plates are provided with recesses extending from front edges thereof in the rearward direction, and, owing to these recesses an angular range in which the shank can be turned more than 90 degrees is secured in both upward and downward directions in respect to the reference plane. The support base plates are provided with stopper pins each of which is joined at its both end portions to these support base plates and adapted to be broken when a turning force larger than the supporting limit is exerted on the shank. These stopper pins limit the angular range in which the shank turns freely smaller than 90 degrees in both the upward and downward directions in respect to the reference plane.

It is preferable that a secondary guide plate reinforcing rod extending between the secondary guide plates be connected to them.

In the Danforth type anchor of the above-described construction, the secondary guide plates are inclined outward at an increased angle in the rearward direction thereof, so that the placing of the front end of the flukes in a downwardly inclined orientation at the bottom of the water is reliably attained. As a result, an orientation in which the Danforth type anchor bits into the sand of the bottom of the water is reliably obtained.

Since the secondary guide plates have inwardly inclined bent rear end portions, the turbulence of water flow occurring while the cast Danforth type anchor is submergeing in the water is restrained, so that the anchor can be made to reach the bottom of the water speedily.

In the Danforth type anchor of a structure provided with stopper pins restricting the range of free turning movement of the shank, either of the stopper pins can be broken by the shank. Therefore, when the anchor becomes incapable of being lifted up by a regular anchor lifting operation, the direction in which the shank extends can be changed, so that an anchor lifting force can be exerted on the anchor in the direction opposite to the direction in which the shank extends in the initial anchored state. Accordingly, an anchor lifting force in the direction in which the flukes are extracted can be exerted on the shank. This enables the lifting of the anchor to be done certainly.

When the anchor is thus extracted in-the backward direction, the sinking or biting of the secondary guide plates into the sand of the bottom of the water is prevented owing to the provision of the inwardly bent rear end portions on the secondary guide plates.

DETAILED DESCRIPTION OF THE PREFERRED EMBODIMENT

The present invention will now be specifically described.

Figure 1:
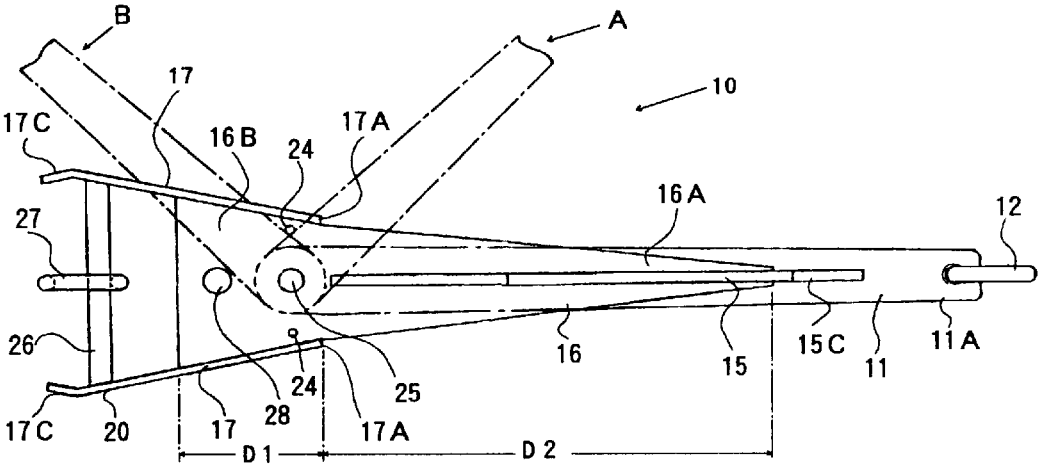
FIG. 1 is a front view of an example of the Danforth type anchor according to the present invention.
Figure 2:
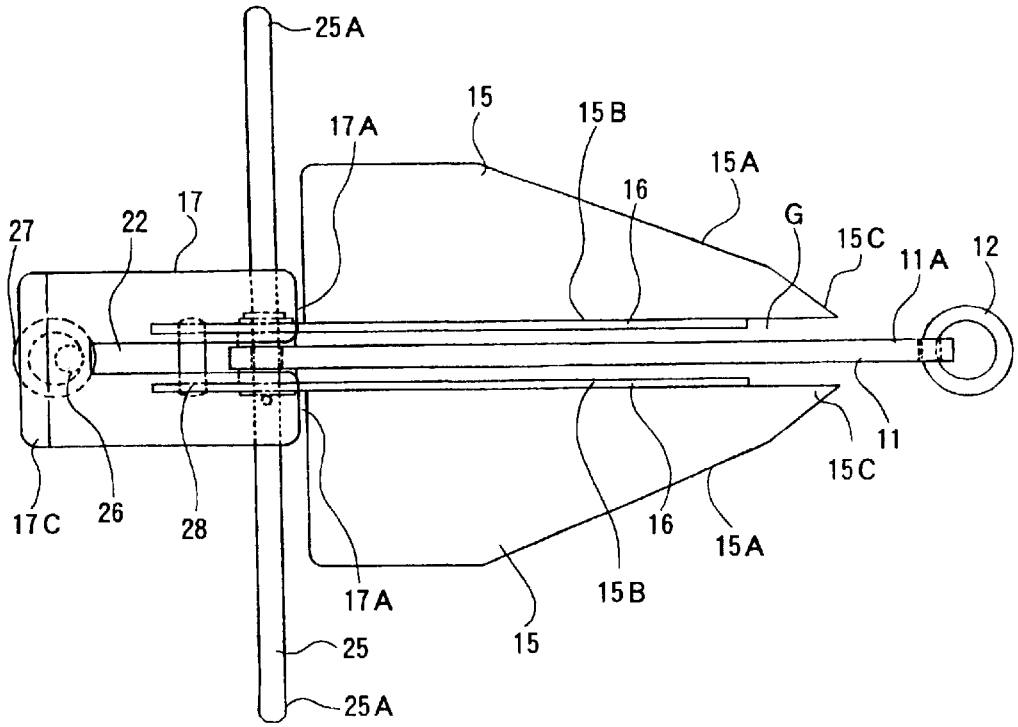
FIG. 2 is a plan view of the Danforth type anchor FIG. 1.

FIG. 1 is a front view of an example of the Danforth type anchor according to the present invention, and FIG. 2 a plan view thereof. In the following paragraphs, "longitudinal direction" refers to the lateral direction of FIG. 1, "vertical direction" the vertical direction of FIG. 1, and "widthwise direction" the vertical direction of FIG. 2.

The Danforth type anchor 10 according to the present invention has a pair of flukes 15, 15 extending in the drawings along a horizontal reference plane L (refer to FIG. 3), and support base plates 16, 16 which extend in parallel with each other in a perpendicular state with respect to the reference plane L and which are provided with the flukes 15, 15 made integral therewith so that the flukes extend sideways from both outer side surfaces of the support base plates.

Each of the support plates 16, 16 is formed of a flat plate having a front portion 16A the upper and lower edges of which are inclined outward toward the rear end (leftward in the drawings) thereof, i.e., with the vertical width of the front portion increasing gradually in the rear direction; and a rear end portion 16B formed integrally with the front portion 16A and having upper and lower edges inclined more outwardly than the extension lines of the upper and lower edges of the front portion 16A. The angle of inclination of the upper and lower edges of the rear end portion 16B with respect to the reference plane L is set larger than that of the upper and lower edges of the front portion 16A with respect to the reference plane L. The longitudinal size D2 of the front portion 16A is set around three times the longitudinal size D1 of the rear end portion 16B.

The support base plates 16, 16 extend in parallel and apart in widthwise direction with each other to form a clearance G between them which is a passage area for the shank 11 to turn, and are provided at their rear end portions 16B, 16B with a pair of secondary guide plates 17, 17 each having longitudinally elongated rectangular shape. These secondary guide plates 17, 17 are provided with recesses 22, 22 extending from central positions of front edges 17A, 17A thereof in the rearward direction, and, owing to these recesses, an admission path for the shank 11 is formed so that the shank 11 passes over the front edges 17A, 17A of the secondary guide plate 17, 17 and turns further in the upward or downward direction. The bottom parts of the recesses 22, 22 determine a limit for the turning movement of the shank 11, and, as in the position B shown by chain lines in FIG. 1, the shank can be turned greatly in both upward and downward directions.

The two secondary guide plates 17, 17 are welded to upper and lower edges of the rear end portions 16B, 16B of the support base plates 16, 16, and extend so as to diverge rearward along the upper and lower edges of the rear end portions 16B, 16B and further project as they are in the direction of the rear extension lines of the support base plates 16, 16 beyond the rear ends thereof. The secondary guide plates 17, 17 are further provided at rear end sections thereof with bent rear end portions 17C, 17C bent so as to incline toward the reference plane L, i.e., in the inward direction.

Each of the secondary guide plates 17, 17 has a generally longitudinally elongated rectangular shape, and it is preferable that a ratio of the longitudinal length of the guide plate to the lateral length thereof be 1.1–2.0, whereby the function of the guide plates as secondary guide plates 17, 17 which will be described later is fully displayed.

The support base plates 16, 16 are also provided in locations close to the front edges 17A, 17A of the secondary guide plates 17, 17 with stopper pins 24, 24 extending across the clearance G, having particular movement limiting strength, and held fixedly at both end portions thereof in a fitted state with respect to through holes formed in the support base plates 16, 16. Owing to this arrangement, the range of a free turning movement of the shank 11 is restricted as in the condition A shown by chain lines in FIG. 1.

The support base plates 16, 16 are further provided with a support base plate reinforcing rod 28, which extends across the clearance G, and is inserted into the through holes formed on the support base plates 16, 16, and then welded at both ends thereof to the support base plates 16, 16 at inner and outer sides thereof.

The location on the rear end portions 16B, 16B in which the support base plate reinforcing rod 28 is provided is set in a region other than the region which the shank 11 passes during its turning movement, so as not to prevent turning movement of the shank 11.

The orientation control rod 25 is provided in the rear of the flukes 15, 15 so as to extend widthwise through the support base plates 16, 16, and fixed in a state that the widthwise movement thereof is prevented. Both of the free end portions 25A, 25A of this orientation control rod 25 project outward greatly to positions beyond the outer edges of the flukes 15, 15 in the anchor 10.

The flukes 15, 15 are formed of flat plates provided by welding, in such a manner that they project outward from outer surfaces of the front portions 16A, 16A of the support base plates 16, 16 in the widthwise direction and extend along the reference plane L. The outer edges of the front parts of the flukes are formed by oblique sides 15A, 15A inclined inward in two stages toward the front ends thereof. The inner edges 15B, 15B of the flukes 15, 15, which are opposed to each other to form the clearance G, extend linearly, and front end portions 15C, 15C project forward slightly beyond the front ends of the support base plates 16, 16 to form sharp end or top defined by the oblique sides 15A, 15A and inner edges 15B, 15B.

The shank 11 is formed of a longitudinally extending plate-like rod, a vertical width of which decreases slightly toward the front end thereof in the illustrated example. The base end portion of the shank 11, which is the rear end thereof, is joined to the orientation control rod 25 so that the shank can be turned freely about the orientation control rod 25 as a pivot. Specifically, the shank 11 is provided in its base end portion with a through hole the inner diameter of which is slightly larger than the outer diameter of the orientation control rod 25, and the orientation control rod 25 is inserted in a loosely fitted state through the through hole.

The longitudinal length of the shank 11 is such that the front end portion 11A thereof extends further forward than the front end portions 15C, 15*c* of the flukes 15, 15, when the shank is positioned in the reference direction (in the illustrated condition) identical with the direction in which the flukes 15, 15 extend. A shank ring 12 is joined to the front end portion 11A.

The secondary guide plates 17, 17 are connected together by welding them to respective ends of the secondary guide plate reinforcing rod 26 extending between them. A reference numeral 27 denotes a connecting ring for a display buoy, provided on the secondary guide plate reinforcing rod 26.

The mode and positional relation of the support base plates 16, 16 and secondary guide plates 17, 17 constituting the Danforth type anchor 10 according to the present invention will now be described with reference to FIG. 3.

Figure 3:
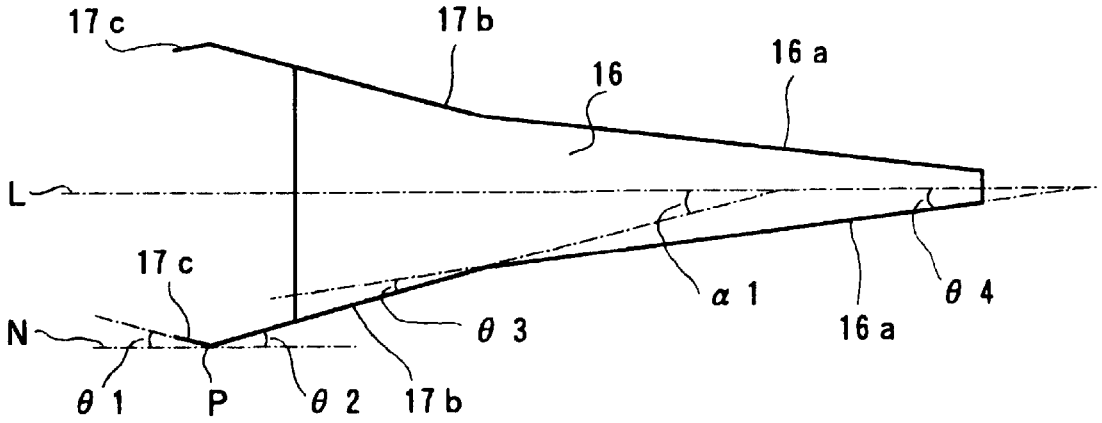
FIG. 3 illustrates in a simplified manner the outer shape of a support base plate and a cross-sectional shape of secondary guide plates of the example of FIG. 1, and is prepared by viewing the parts from the front just as in FIG. 1.

FIG. 3 illustrates the contour of the support base plate 16 and a cross-sectional shape of the secondary guide plates 17 in a simplified manner, and are prepared by viewing the parts from the front side thereof just as FIG. 1.

Referring to FIG. 3, reference numerals 16*a*, 16*a* denote the upper and lower edges of the front portion 16A of the support base plate 16, numerals 17*b*, 17*b* denote line-drawn cross-sectional shapes of the secondary guide plates 17, 17, and numerals 17*c*, 17*c* denote line-drawn cross-sectional shapes of the bent rear end portions 17C, 17C. L denotes the reference plane in which the flukes 11, 11 extend, and N denotes the plane passing through the bending point P of the bent rear end portion 17C and parallel to the reference plane L.

The Danforth type anchor 10 is formed in a vertically symmetric manner in respect of the reference plane L.

An angle of inclination θ4 to the reference plane L of the upper and lower edges 16*a*, 16*a* of the support base plate 16 is set in the range of 5–12 degrees, for example, 7 degrees.

The angle of inclination θ3 of the secondary guide plates 17*b*, 17*b* with respect to extension lines of the upper and lower edges 16*a*, 16*a* of the support base plate 16 is set in the range of 3–10 degrees, for example, 5 degrees. The angle of inclination θ2 to the plane N of the secondary guide plates 17*b*, 17*b* is set in the range of 8–22 degrees, for example, 12 degrees.

The angle of inclination θ2 of the secondary guide plate 17 is set larger than that θ4 of the upper or lower edge of the support base plate 16, and equal to an angle of inclination α1 with respect to the reference plane L of the upper or lower edge of the rear end portion 16B of the support base plate 16. Thus, the secondary guide plates 17*b*, 17*b* extend in a further outward direction than the extension lines of the upper and lower edges 16*a*, 16*a* of the support base plate 16.

The angle of inclination θ1 of the bent rear end portions 17*c*, 17*c* with respect to the plane N is set in the range of 8–22 degrees, for example, 12 degrees.

When the Danforth type anchor of such a structure is cast from a ship into the water, the anchor submerges under water with the base unit 20 lowermost. Since the secondary guide plates 17, 17 have inwardly inclined bent rear end portions 17C, 17C, the anchor as a whole is formed streamlined, and the turbulence of a water flow is restrained. This causes a submerging speed of the anchor to increase, so that the anchor reaches the bottom of the water in a short period of time.

Figure 4:
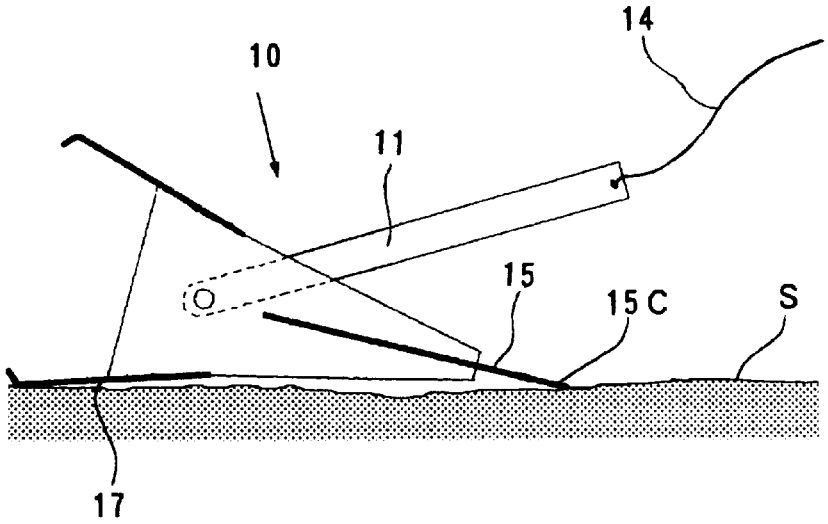
FIG. 4 illustrates a practical manner of operation of the Danforth type anchor according to the present invention.

Since the secondary guide plates 17, 17 extend in the further outward direction toward their rear portions away from the extension lines of the upper and lower edges of the front portions 16A of the support base plates 16, the fixing of the anchor to the bottom of the water is attained reliably. Namely, when one secondary guide plate 17 of the Danforth type anchor 10 comes into contact with a water bottom surface S, and is stabilized in a horizontally laying state as shown in FIG. 4, the front end portion 15C of the fluke 15 certainly assumes a diagonally downwardly directed orientation. Accordingly, when the Danforth type anchor 10 is then pulled forward by the ship via the mooring rope 14 and the like joined to the front end portion of the shank 11, the front end portion 15C of the fluke 15 is put in a water bottom sand-thrust state, and further sinks as it is so as to bit into the sand in the bottom of the water. As a result, the Danforth type anchor is fixed reliably to the bottom of the water, so that a desired anchoring effect can be obtained reliably without lengthening the mooring rope 14 even in the condition in which, for example, waves are high and wind is strong. This prevents a pointless increasing of the area in which the ship on the surface of the water may move.

Figure 5:
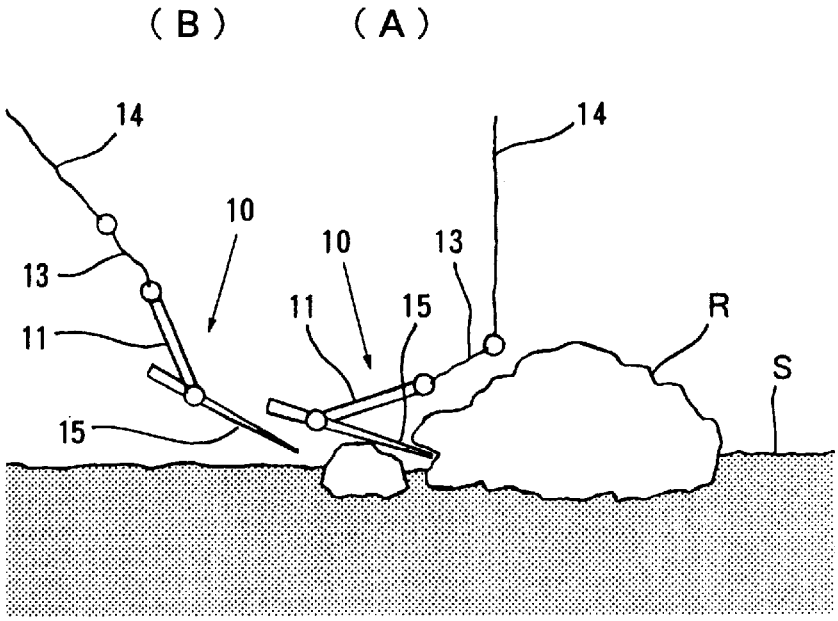
FIG. 5 illustrates possible postures of the Danforth type anchor in the water.
Figure 6:
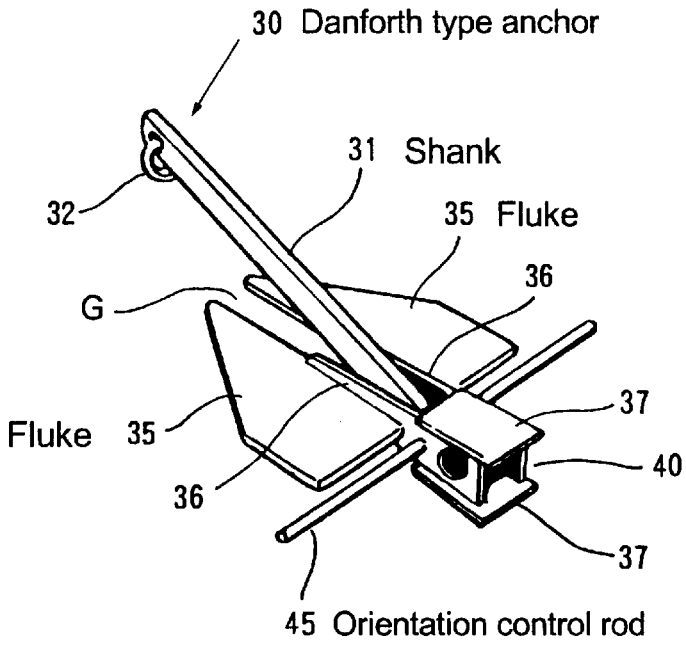
FIG. 6 is a perspective view for describing a Danforth type anchor of the prior art.
Figure 7:
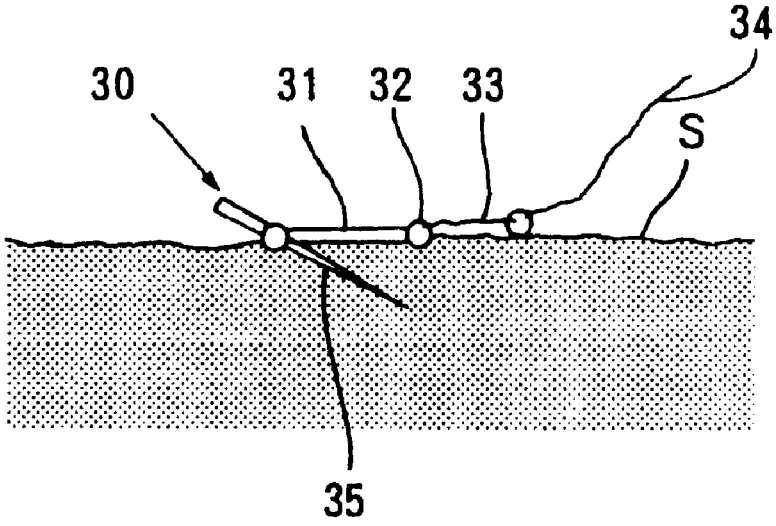
FIG. 7 is an explanatory drawing showing a state of a Danforth type anchor under operation.

As shown at the position (A) of FIG. 5, when the flukes 15, 15 of the Danforth type anchor bit into a crack of a shore reef R, and the anchor is unable to be lifted by a regular anchor lifting operation wherein the Danforth type anchor is, as a whole, an acute bent condition which is a condition in normal use (position (A) shown in FIG. 1), the stopper pin 24 whish has been positioned at upper position of the anchor is broken by the shank 11 and the shank 11 is turned, so that the anchor as a whole can be put in an obtusely bent position (B) (position (B) shown in FIG. 1) as shown in FIG. 5 from the acute bent position (A). As a result, the anchor can be extracted backwardly with the secondary guide plates 17, 17 become forefront. In addition, during the operation, the sinking of the secondary guide plates 17 into the sand of the bottom of the water is prevented owing to the provision of the bent rear end portions 17C, 17C in the secondary guide plates 17, 17, so that the lifting of the anchor can be done fully reliably.

The present invention has been specifically described. According to the present invention, the concrete specifications including the dimensions or sizes and weight, and the shape of minute portions can be designed freely in accordance with the scale of the ship concerned, the condition of the anchorage water area and other conditions.

In the Danforth type anchor according to the present invention, the secondary guide plates are inclined outward at a greatly increased angle toward their rear ends, so liably attains on the bottom of the water the assumption of an orientation with the front end portions of the flukes directed downward. Consequently, the condition of the Danforth type anchor biting into the sand of the bottom of the water is reliably attained, whereby a reliable anchoring effect can be obtained.

Since the secondary guide plates have inwardly inclined bent rear end portions, the turbulence of water flow occurring while the cast Danforth type anchor is submerging under water is restrained, and the anchor can therefore be made to reach the bottom of the water rapidly. Accordingly, an anchoring effect can be obtained quickly.

According to a structure provided with stopper pins restricting the range in which the shank is turned freely, either of the stopper pins can be broken by the shank. Therefore, when the anchor cannot be lifted up by a regular anchor lifting operation, the direction in which the shank extends can be changed by breaking either of stopper pins. Accordingly, an anchor lifting force can be exerted on the anchor in the direction opposite to the direction in which the shank extends in the initially fixed state. This enables an anchor lifting force in the direction in which the flukes are extracted to be exerted on the shank, and the lifting of the anchor is thereby certainly attained.

When the anchor is thus extracted in the backward direction, the sinking or biting of the secondary guide plates into the sand of the bottom of the water is prevented since the secondary guide plates have the inwardly bent rear end portions. As a result, the lifting of the anchor can be surely accomplished.

What is claimed is:

1. A Danforth type anchor comprising a base unit; a pair of flat plate flukes projecting horizontally outward from both sides of the base unit, extending forward to form sharp front ends, and being made integral with the base unit; a shank joined at its base end portion to the base unit so as to turn in a plane of pivotal movement which is at right angles to a reference plane in which the flukes extend, passing through the clearance between the flukes; and an orientation control rod provided in the base unit, projecting horizontally outward from both sides thereof, the base unit including (A) two parallel flat plate-like support base plates each of which is formed of (i) a front portion extending at right angle to the reference plane in which the flukes extend and having upper and lower edges inclined outward toward rear end thereof, and (ii) a rear end portion formed integrally with the front portion, having upper and lower edges inclined in a further outward directions than the extension lines of the upper and lower edges of the front portion; and (B) a pair of secondary guide plates fixed to the inclined upper and lower edges of the rear end portions of the support base plates and extending to project rearward outward from the rear ends of the support base plates.

2. A Danforth type anchor according to claim 1, wherein the angle of inclination of the upper and lower edges of the front portions of the support base plates with respect to the reference plane is in the range of 5 to 12 degrees.

3. A Danforth type anchor according to claim 2, wherein the angle of inclination of the upper and lower edges of the rear end portions of the support base plates with respect to the extension lines of the upper and lower edges of the front portions thereof is in the range of 3 to 10 degrees.

4. A Danforth type anchor according to claim 1, wherein the secondary guide plates are provided with recesses extending from front edges thereof in the rearward direction, the recesses permitting an angular range in which the shank can be turned more than 90 degrees in both upward and downward directions in respect to the reference plane, the support base plates being provided with stopper pins each of which is joined at its both end portions to the support base plates and adapted to be broken when a turning force larger than the supportable limit is exerted on the shank, and both of which limit the angular range in which the shank turns freely smaller than 90 degrees in both the upward and downward directions in respect to the reference plane.

5. A Danforth type anchor comprising a base unit; a flat of plate flukes projecting horizontally outward from both sides of the base unit, extending forward to form sharp front ends, and being made integral with the base unit; a shank joined at its base end portion to the base unit so as to turn in a plane of pivotal movement which is at right angle to a reference plane in which the flukes extend, passing through the clearance between the flukes; and an orientation-control rod provided in the base unit, projecting horizontally outward from both sides thereof, the base unit including (A) two parallel flat plate-like support base plates each of which is formed of (i) a front portion extending at right angle to the reference plane in which the flukes extend and having upper and lower edges inclined outward toward the rear end thereof, and (ii) a rear end portion formed integrally with the front portion and having upper and lower edges inclined outward; and (B) a pair of secondary guide plates fixed to the inclined upper and lower edges of the rear end portions of the support base plates and extending to project rearward outward from the rear ends of the support base plates, the secondary guide plates having at their respective rear end sections bent rear end portions being bent to incline inward.

6. A Danforth type anchor according to claim 5, wherein the angle of the bent rear end portions of the secondary guide plates with respect to the reference plane is in the range of 8–22 degrees.

7. A Danforth type anchor according to claim 5, wherein each of the secondary guide plates has a longitudinally elongated rectangular shape, and a ratio of a longitudinal size to a lateral size thereof of 1.2–2.0.

8. A Danforth type anchor according to claim 5, wherein each of the rear end portions of the support base plates has upper and lower edges inclined in a further outward directions than the extension lines of the upper and lower edges of the front portion thereof.

9. A Danforth type anchor according to claim 5, wherein the secondary guide plates are provided with recesses extending from front edges thereof in the rearward direction, the recesses permitting an angular range in which the shank can be turned more than 90 degrees in both upward and downward directions in respect to the reference plane, the support base plates being provided with stopper pins each of which is joined at its both end portions to the support base plates and adapted to be broken when a turning force larger than the supportable limit is exerted on the shank, and both of which limit the angular range in which the shank turns freely smaller than 90 degrees in both the upward and downward directions in respect to the reference plane.

10. A Danforth type anchor according to claim 5, wherein the secondary guide plates are connected together by a secondary guide plate reinforcing rod extending between them.

* * * * *